US006374819B1

(12) United States Patent
Ming-Hsien

(10) Patent No.: US 6,374,819 B1
(45) Date of Patent: Apr. 23, 2002

(54) PAINTBALL FEEDING DEVICE FOR PAINTBALL MARKERS

(76) Inventor: Chen Ming-Hsien, 11F-2, No. 43, Chai-1 Steet, Taichung City (TW)

( * ) Notice: Subject to any disclaimer, the term of this patent is extended or adjusted under 35 U.S.C. 154(b) by 0 days.

(21) Appl. No.: 09/751,817

(22) Filed: Jan. 2, 2001

(51) Int. Cl.[7] ..... F41B 11/02

(52) U.S. Cl. ..... 124/49

(58) Field of Search ..... 124/45, 49, 73, 124/74, 82

(56) References Cited

U.S. PATENT DOCUMENTS 3,788,298 A * 1/1974 Hale
5,285,765 A * 2/1994 Lee ..... 124/45 X
5,673,679 A * 10/1997 Walters ..... 124/73 X

* cited by examiner

*Primary Examiner*—John A. Ricci
(74) *Attorney, Agent, or Firm*—Charles E. Baxley

(57) ABSTRACT

A paintball feeding device for a paintball marker which has a hole defined in a barrel thereof and the feeding device includes a tubular body connected to the barrel and communicating with the hole of the barrel. An end member is snapped to an end of said tubular body by receiving two protrusions on the end member in two apertures in the tubular body.

8 Claims, 5 Drawing Sheets

PAINTBALL FEEDING DEVICE FOR PAINTBALL MARKERS

FIELD OF THE INVENTION

The present invention relates to a paintball feeding device for paintball markers wherein an end member having an inclined surface for contacting the paintballs is snapped to a tube so that the end member is easily connected to the tube.

BACKGROUND OF THE INVENTION

A conventional paintball feeding device for a paintball marker is shown in FIG. 1 and generally includes a tubular body 10 connected to a barrel 1 of the paintball marker. A hole 11 communicates with the barrel 1 and the body 10. An end member 13 is connected to a lower end of the body 10 and a seal 14 seals the gap between the body 10 and the end member 13. Paintballs 15 are put in the body 10 from a top open end of the body 10 and the lowest paintball 15 contacts an inclined surface of the end member 13 so as to roll into the barrel 1 via the hole 11. The end member 13 could be loosened or rotated because the seal 14 will be fatigued or solidified and the end member 13 is slightly rotated. The inclined surface is rotated together with the end member 13 so that the paintballs 15 are located at positions which they will not easily or smoothly roll into the barrel 1.

The present invention intends to provide an end member of the feeding device wherein the end member is snapped with the tubular body so that it will not be rotated.

SUMMARY OF THE INVENTION

In accordance with one aspect of the present invention, there is provided a paintball feeding device for a paintball marker which has a hole defined in a barrel thereof and a tubular body is connected to the barrel and communicates with the hole of the barrel. Two apertures are defined through the tubular body and an end member is engaged with an end of the tubular body. The end member has two flanges extending from an end of the end member and the two flanges are separated by two slits. Each flange has a protrusion extending therefrom which is engaged with and respective one of the two apertures in the tubular body.

The primary object of the present invention is to provide a paintball feeding device for a paintball marker wherein the end member is snapped to the tubular body so that the end member will not rotate or loosen.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 3:
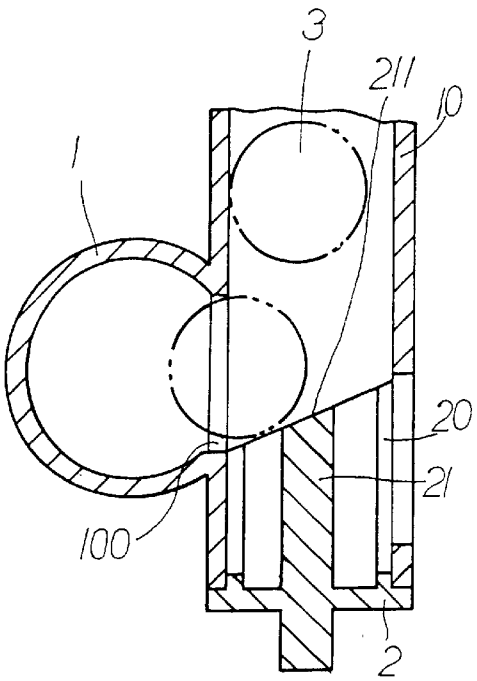
FIG. 3 is a cross sectional view to show the end member is rotated to be snapped to the tubular body on the paintball marker.
Figure 4:
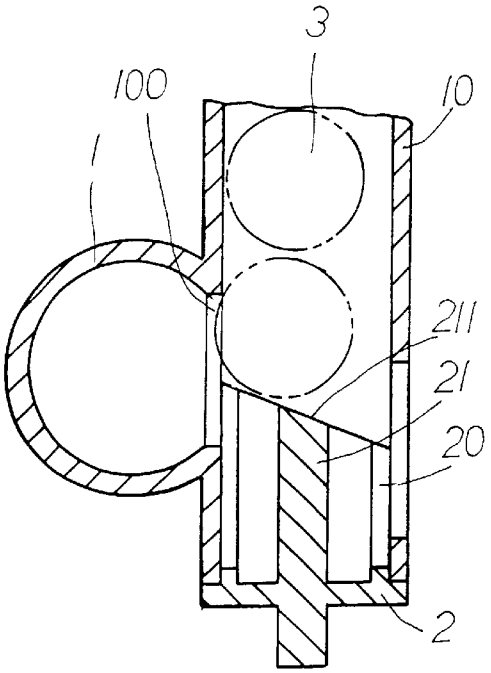
FIG. 4 is a cross sectional view to show the end member is snapped to the tubular body on the paintball marker.
Figure 1:
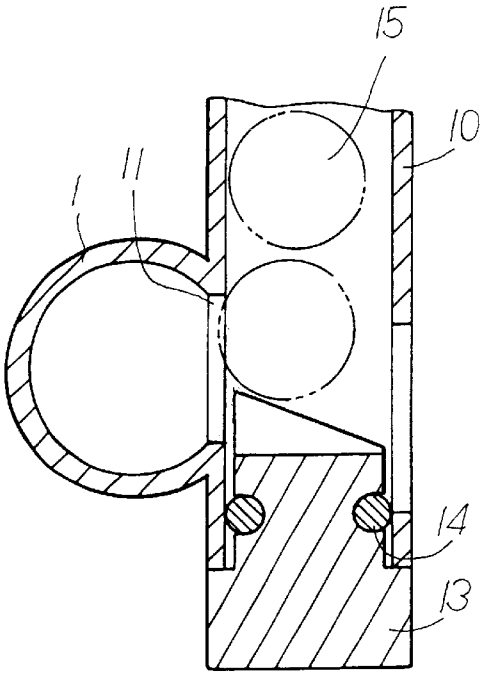
FIG. 1 PRIOR ART
FIG. 1 is a cross sectional view to show a conventional paintball feeding device.
Figure 2:
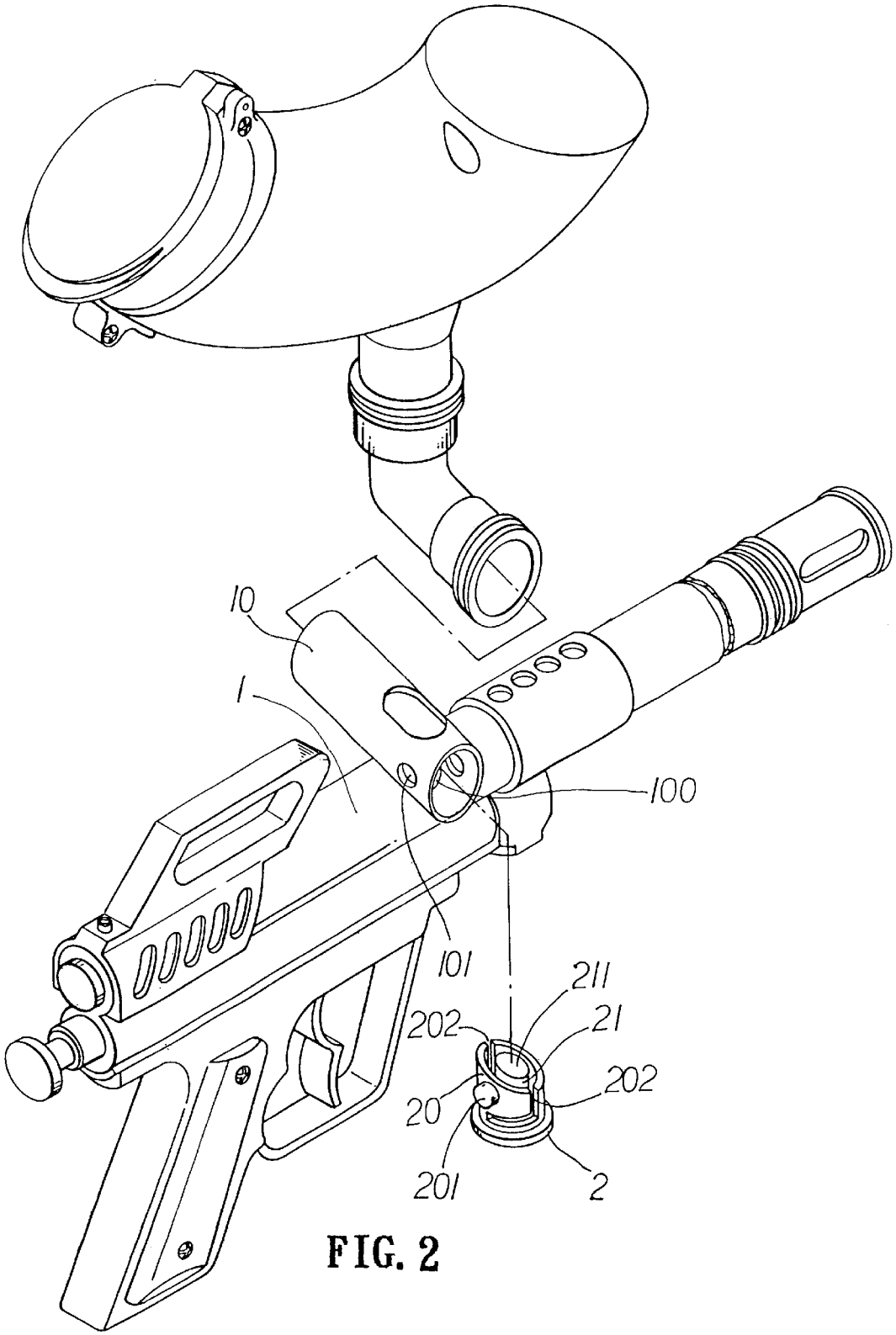
FIG. 2 is an exploded view to show a paintball marker and a paintball feeding device of the present invention.
Figure 6:
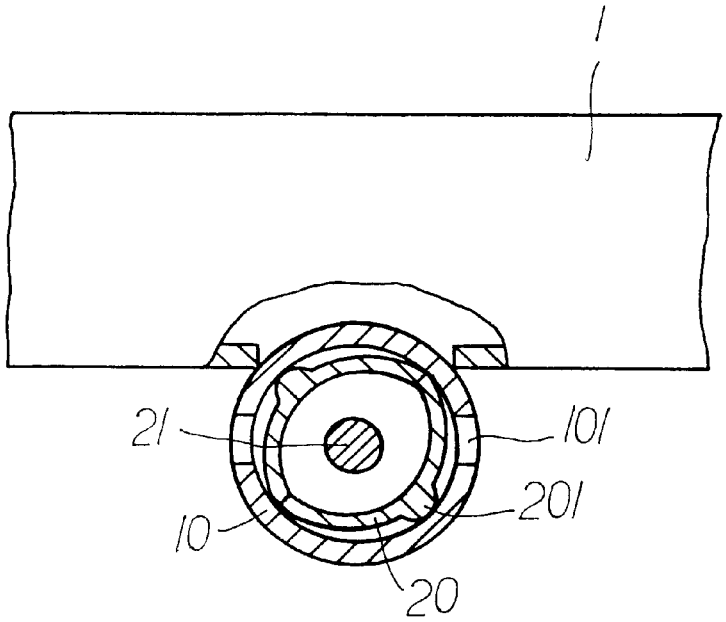
FIG. 6 is a top cross sectional view to show the end member is snapped to the tubular body on the paintball marker.
Figure 5:
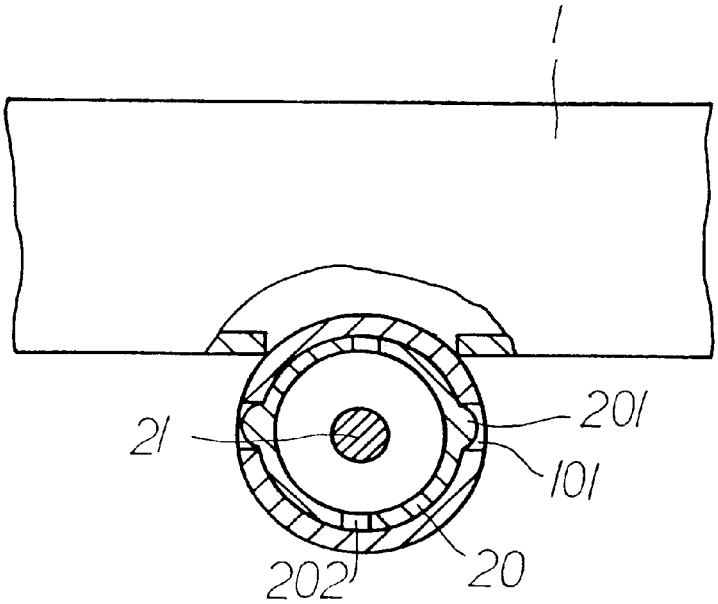
FIG. 5 is a top cross sectional view to show the end member is rotated to be snapped to the tubular body on the paintball marker.

Referring to FIG. 2, the paintball feeding device for a paintball marker of the present invention comprises a tubular body 10 connected to a barrel 1 of the paintball marker and communicating with a hole 100 of the barrel 1. Two apertures 101 are defined through the tubular body 10 and an end member 2 is engaged with an end of the tubular body 10. The end member 2 has two flanges 20 extending from an end of the end member 2 and the two flanges 20 are separated by two L-shaped slits 202 so that the two flanges 20 are flexible. Each flange 20 has a protrusion 201 extending therefrom and the two protrusions 201 are engaged with the apertures 101 in the tubular body 10 when the end member 2 is connected to the tubular body 10. As shown in FIGS. 3 to 6, the flanges 20 slightly compressed inward when inserted into the tubular body 10 and the end member 2 is then rotated till the two protrusions 201 are engaged with the two apertures 101. By this way, the end member will not loosen or rotated. A rod 21 extends from the end member 2 and is located between the two flanges 20. The rod 21 has an inclined distal surface 211 so as to guide the paintballs 3 to roll into the hole 100.

Figure 7:
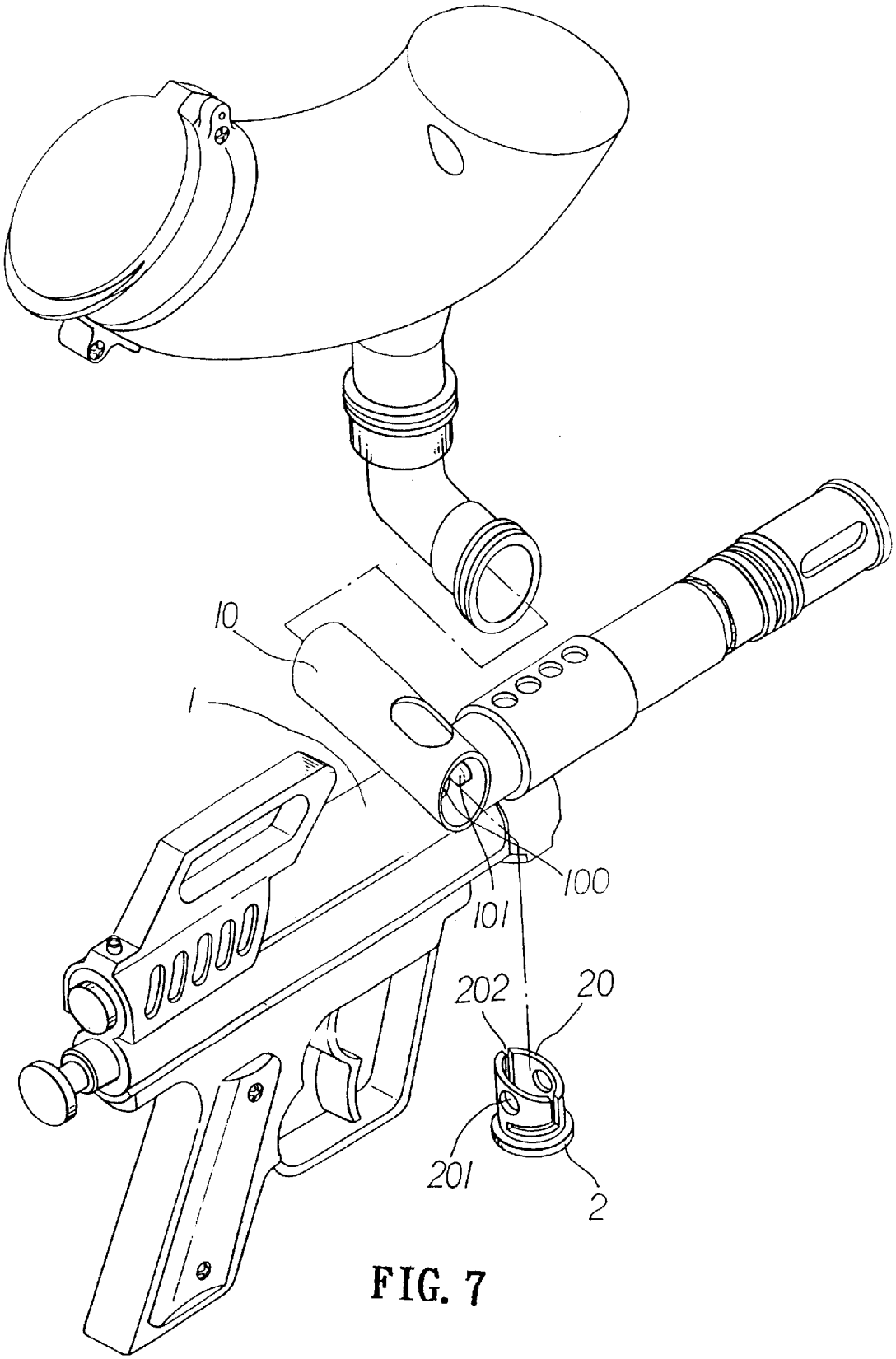
FIG. 7 is a exploded view to show another embodiment of the paintball marker and the paintball feeding device of the present invention.
Figure 8:
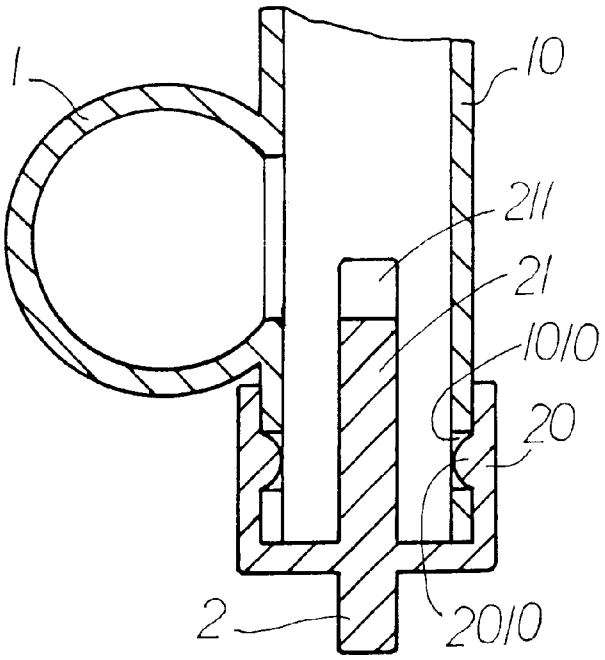
FIG. 8 is a cross sectional view to show yet another embodiment the end member and the tubular body on the paintball marker.
Figure 9:
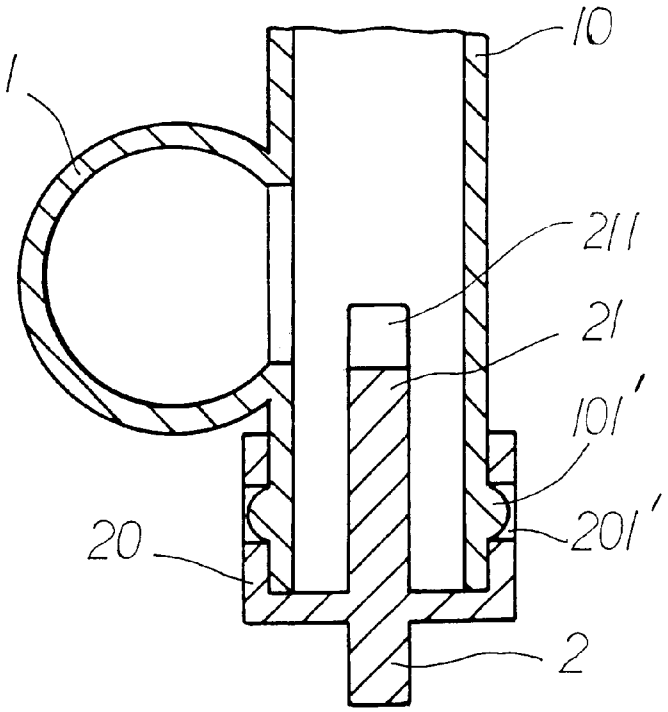
FIG. 9 is a cross sectional view to show a further embodiment of the end member and the tubular body on the paintball marker.

FIG. 7 shows that the two protrusions 101 extend from an inner periphery of the tubular body 10 and each flange 20 of the end member 2 has an aperture 201 defined therethrough so as to receive a respective one of the two protrusions 101. FIG. 8 shows that the end of the tubular body 10 is inserted between the flanges 20 of the end member 2. Two protrusions 2010 extend from an inner side of the two flanges 20 and are inserted into the apertures 1010 in the tubular body 10. FIG. 9 shows that the end of the tubular body 10 is inserted between the flanges 20 of the end member 2. Two protrusions 101' extend from an outer periphery of the tubular body 10 and two apertures 201' are defined through the two flanges 20 so that the protrusions 101' are inserted into the apertures 201'.

Each one of the embodiments shown above ensures that the end member 2 will not rotate so that the paintballs can precisely enter into the barrel 1.

While we have shown and described various embodiments in accordance with the present invention, it should be clear to those skilled in the art that further embodiments may be made without departing from the scope and spirit of the present invention.

What is claimed is:

1. A paintball feeding device for a paintball marker which has a hole defined in a barrel thereof, comprising:

a tubular body adapted to be connected to the barrel and communicating with the hole of the barrel, two apertures defined through said tubular body, and an end member engaged with an end of said tubular body and having two flanges extending from an end of said end member, said two flanges being separated by two slits, each flange having a protrusion extending therefrom and said two protrusions engaged with said apertures in said tubular body.

2. The device as claimed in claim 1 further comprising a rod extending from said end member and located between said two flanges.

3. The device as claimed in claim 2, wherein said rod has an inclined distal surface.

4. The device as claimed in claim 1 wherein each slit is an L-shaped slit.

5. A paintball feeding device for a paintball marker which has a hole defined in a barrel thereof, comprising:

a tubular body adapted to be connected to the barrel and communicating with the hole of the barrel, two protrusions extending from an inner periphery of said tubular body, and an end member engaged with an end of said tubular body and having two flanges extending from an end of said end member, said two flanges being separated by two slits, each flange having an aperture defined therethrough and said protrusions of said tubular body received in said apertures.

6. The device as claimed in claim 5 further comprising a rod extending from said end member and located between said two flanges.

7. The device as claimed in claim 6, wherein said rod has an inclined distal surface.

8. The device as claimed in claim 5 wherein each slit is an L-shaped slit.

* * * * *